US006289826B1

(12) United States Patent
Waisbrod

(10) Patent No.: US 6,289,826 B1
(45) Date of Patent: Sep. 18, 2001

(54) WORK STATION SUPPORT AND/OR A MOUNTING BRACKET USED IN SAID WORK STATION SUPPORT

(75) Inventor: Neville Waisbrod, Wellington (NZ)

(73) Assignee: Formway Furniture Limited, Wellington (NZ)

( * ) Notice: Subject to any disclaimer, the term of this patent is extended or adjusted under 35 U.S.C. 154(b) by 0 days.

(21) Appl. No.: 09/446,936

(22) PCT Filed: Jun. 22, 1998

(86) PCT No.: PCT/NZ98/00088

§ 371 Date: May 30, 2000

§ 102(e) Date: May 30, 2000

(87) PCT Pub. No.: WO99/00036

PCT Pub. Date: Jan. 7, 1999

(30) Foreign Application Priority Data

Jun. 26, 1997 (NZ) ..... 328194

(51) Int. Cl.[7] ..... A47B 13/00; A47B 96/06

(52) U.S. Cl. ..... 108/157.1; 248/221.12; 248/222.41; 248/222.52

(58) Field of Search ..... 108/152, 157.1, 108/157.13, 157.16, 180; 248/221.12, 222.41, 223.21, 222.52, 235, 918, 218.4, 230.1, 220.22

(56) References Cited

U.S. PATENT DOCUMENTS

| | | | | |
|---|---|---|---|---|
| 1,748,433 | * | 2/1930 | Wetzell et al. | 312/35 |
| 1,838,935 | * | 12/1931 | Fixsen | 248/222.52 |
| 1,956,164 | * | 4/1934 | Voight | 108/152 |
| 4,735,152 | * | 4/1988 | Bricker | 108/97 |
| 5,154,386 | | 10/1992 | Heck | 248/230 |
| 5,381,738 | * | 1/1995 | Meyer | 108/42 |
| 5,580,018 | * | 12/1996 | Remmers | 248/235 |

FOREIGN PATENT DOCUMENTS

| | | |
|---|---|---|
| A-70986/91 | 8/1991 | (AU) . |
| 4436769A1 | 4/1996 | (DE) . |
| 0069235 | 6/1982 | (EP) . |
| 0268802 | 10/1987 | (EP) . |
| 1383654 | 2/1975 | (GB) . |
| 1437740 | 6/1976 | (GB) . |
| 1560724 | 2/1980 | (GB) . |
| 09206150A | 8/1997 | (JP) . |
| WO97/16997 | 5/1997 | (WO) . |

* cited by examiner

*Primary Examiner*—Ramon O. Ramirez
*Assistant Examiner*—Jon Szumny
(74) *Attorney, Agent, or Firm*—Workman, Nydegger & Seeley

(57) ABSTRACT

A work station support comprises two mounting brackets (4) arranged in use to be attached to a work station top (1) at a spaced relationship. Each mounting bracket (4) has a fixing plate (5) and an arm (6) extending from said fixing plate (5), two separate key hole slots (11, 12) formed in said fixing plate (5) at a locus about a center of rotation of said fixing plate (5). The wider part (13) of each key hole slot is adapted to engage over the head of a mounting stud (17) in use and upon rotation of the fixing plate (5), the stud is moved to the narrower part (14) of each key hole slot (11, 12). The said key hole slots (11, 12) are formed to require the fixing plates (5) to be rotated in opposite directions to move to the engaged position. Holding means (7) is provided at or adjacent the end of each arm (6) and a support means (18) is engageable with the holding means (7) when the mounting brackets are engaged in position, with the fitted support means (18) locking the mounting brackets (4) in the engaged position. The support means comprises posts (18) extending up from the holding means (7). Shelf support means (20) are associated with the posts (18) and operable to support a shelf (2). A shelf back stop (25) is engageable with the posts (18) to provide a stop, limiting movement of articles on the shelf (2) rearwardly. A retaining means is slidably mounted on said back stop to retain articles supported on said shelf.

29 Claims, 4 Drawing Sheets

WORK STATION SUPPORT AND/OR A MOUNTING BRACKET USED IN SAID WORK STATION SUPPORT

BACKGROUND

This invention relates to a work station support and a mounted bracket for use in work station support.

In the modern office environment, a work station should be designed to provide an ergonomically acceptable and convenient environment for a worker. Included in the requirements is a need for work station supports which can carry shelves or screens to create the required holding space and space separation. "Work station" as used in this specification is intended to cover any operator area where there is a desk or top for enabling office type work to be undertaken.

There are many systems recognised for providing a stable support for shelves associated with a working environment for example, the universal shelf system disclosed in U.S. Pat. No. 4,098,408, the means of providing a convenient fitting for a cantilever shelf as disclosed in U.S. Pat. No. 4,736,918 and the means of locking the shelf in position as disclosed in U.S. Pat. No. 4,324,379. Within the modem office environment it is desirable to provide a fitting for supporting a shelf or screen which can be engaged in position and once in position held or locked in place. It is also advantageous if assembly can be preformed without the assistance of a skilled artisan and preferably without requiring any tools.

PRESENT INVENTION

The present invention is directed to providing a work station support which is effective and secure in use but which may be easily assembled or dismantled for example allowing a work station to be adapted for changing conditions in the work place.

In one aspect the invention consists of a work station support comprising two mounting brackets arranged in use to be attached to a work station top at a spaced relationship, each mounting bracket having a fixing plate and an arm extending from said fixing plate, two separate key hole slots formed in said fixing plate at a locus about a centre of rotation of said fixing plate, the wider part of each key hole slot being adapted to engage over the head of a mounting stud in use and upon rotation of the fixing plate for the studs to be moved to the narrower part of each key hole slot for engaging the mounting bracket to the work station with the end of the arm when the fixing plate is in the engaged position locatable in an accessible position, said key hole slots being formed to require the fixing plates to be rotated in opposite directions to move to the engaged position, holding means at or adjacent the end of each arm support means engageable with said holding means when the mounting brackets are engaged in position with the fitted support means locking each mounting bracket in the engaged position.

In another aspect the invention consists in a mounting bracket comprising a fixing plate arranged to engage the surface of a work station top, an arm extending from said fixing plate with the end of the arm arranged in use to be located in an accessible position when the fixing plate is engaged with the work station top, holding means at or towards the free end of the arm, two separate key hole slots in said fixing plate, said key hole slots being formed on a locus about a centre of rotation of said fixing plates so that in use the wider part of each key hole slot may be engaged over the heads of mounting studs and the fixing plate rotated to move the studs to the narrower part of the key hole slot so that the fixing plate in use is engaged with the work station top.

DRAWING DESCRIPTION

A preferred embodiment of the invention will now be described with reference to the accompany drawings in which.

PREFERRED EMBODIMENT

The present invention is designed to provide a work station support which will allow the mounting of a shelf or shelves and/or a screen relative to the work station top. The work station top may be the top of a desk or a bench or any other flat work surface that is located and designed to provide the working environment for a worker.

Figure 1:
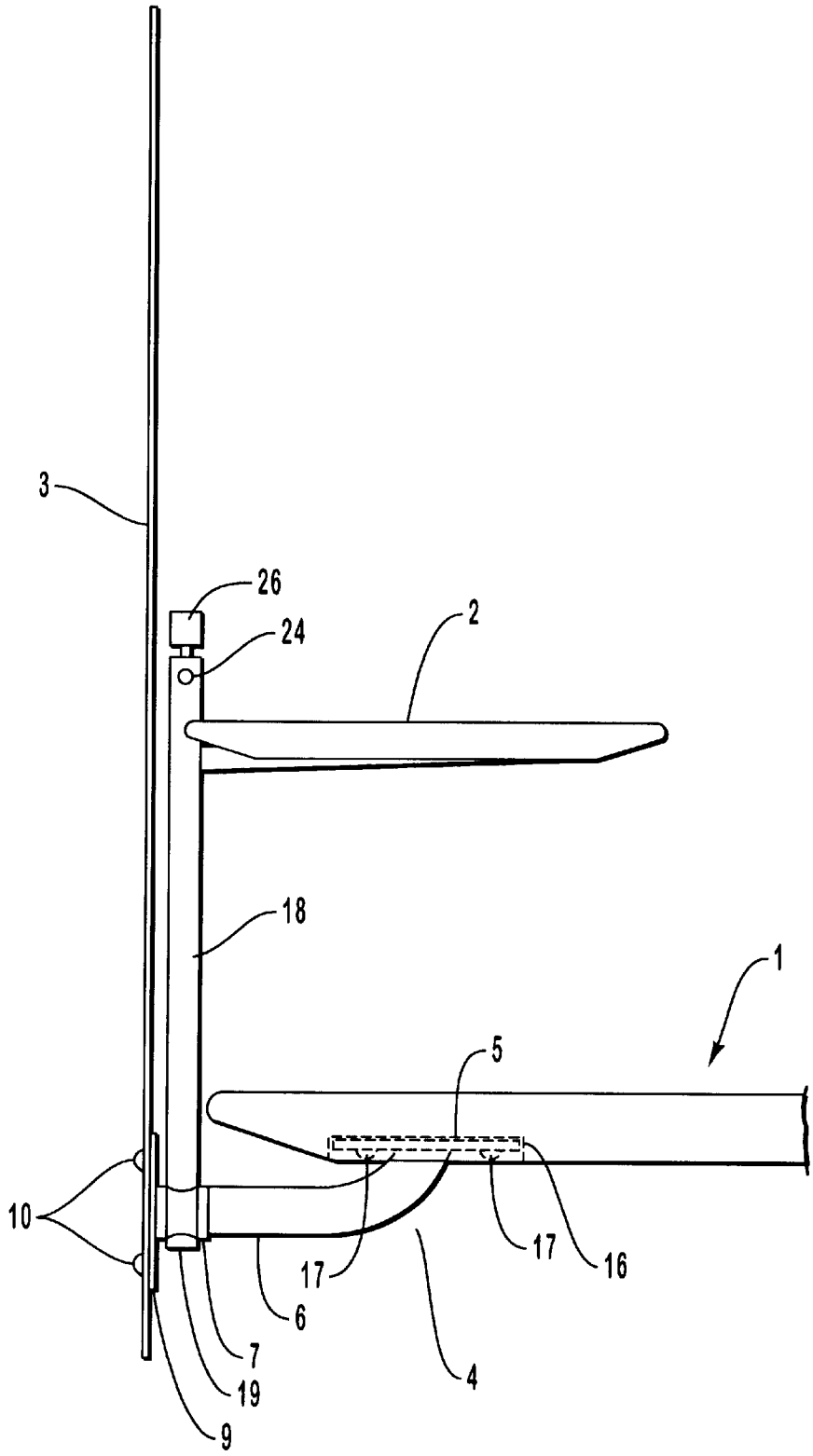
FIG. 1 is an elevation showing a work station support according to the present invention fitted in place on a work station.

In FIG. 1 the work station top 1 has associated therewith a shelf 2 and a screen 3 using the work station support according to the present invention. The work station support has two mounting brackets 4 attached to the under surface of a work station top 1 at a spaced relationship.

Figure 2:
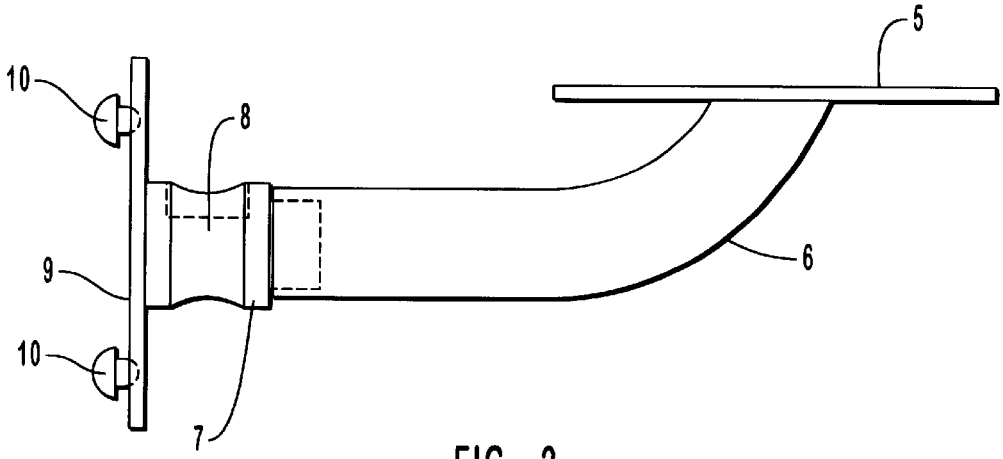
FIG. 2 is a side elevation of the mounting bracket used in the work station support.
Figure 3:
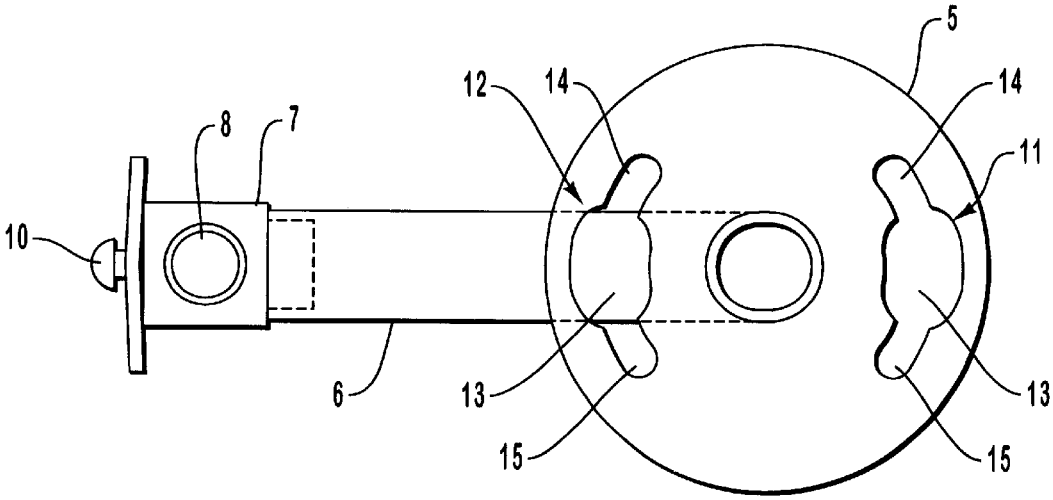
FIG. 3 is a plain view of the mounting bracket in FIG. 2.
Figure 4:
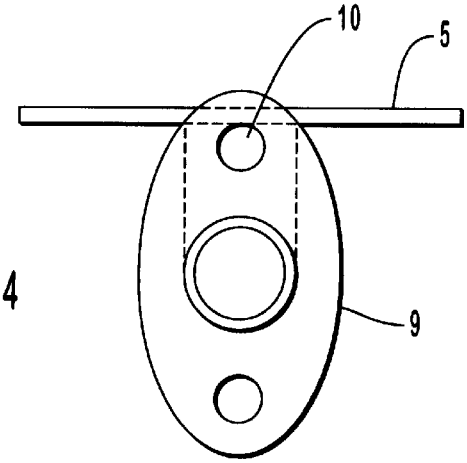
FIG. 4 is an end view of the mounting bracket.

The mounting bracket 4 is detailed in FIGS. 2 to 4 of the drawings and has a circular fixing plate 5 with an arm 6 extending centrally from the under surface thereof and arranged so that in use the end or head 7 of the arm protrudes beyond the edge of the work station top. In use the circular fixing plate of each mounting bracket 4 is fixed in a complimentary recess extending in from the under surface of the work station top as will be described here below.

An aperture or socket 8 is formed through the head 7 and located when the bracket is engaged in place so that a post supported in the aperture 8 will rise substantially vertically from the work station top.

A face plate 9 is attached to the outer end of the head 7 and on the outside face of the face plate are located two headed studs 10 substantially in line with the axis through the aperture 8. The headed studs 10 are arranged to engage with apertures in the screen 3 to enable the screen 3 to be supported in a position as illustrated in FIG. 1.

The circular fixing plate 5 of the mounting bracket 4 has formed therein two key hole slots or openings 11 and 12 preferably arranged diametrically opposed to each other and on a locus about the centre of the plate 5. Each key hole opening has a central part 13 with narrower extensions 14 and 15 on the locus about the centre of the plate and extending in either direction from the central aperture 13. This gives an either handed operation to the bracket 4 but it will be understood that it would be possible within the ambit of the invention to create the brackets so that the key hole slots function with either a left or right handed operation.

Also while less convenient the mounting bracket could operate with other than a circular fixing plate and with the keyhole slots arranged in other than a strictly diametrical opposed configuration.

On the under side of the work station top is formed a circular recess 16 of a size to cooperatively receive the circular fixing plate 5, two headed studs 17 are pre-positioned in the recess and arranged to be engaged by the key hole slots in the fixing plate 5. This means that the fixing studs 17 are located so they do not protrude from the under surface of the work station top ensuring greater convenience in handling the work station top during transportation to the site for assembly.

When the work station site has been assembled the two sites for the mounting brackets 4 each have fixed thereto a mounted bracket 4 by engaging the fixing plate 5 over the studs and rotating the arms 6 towards each other, that is taking advantage of the either handed operation of the apertures in the fixing plate. This operation can quickly and easily be performed without any tools and leaves the fixing brackets in an engaged position extending from the work station top ready to receive a screen or a shelf support frame.

Once the brackets have been fitted in place the screen 3 can be engaged from the headed studs 10. The screen will thus operate to retain the brackets in place. Alternatively the shelf support frame can be engaged with the arms and will also serve the same function. Clearly as illustrated in FIG. 1 both the screen and shelf support frame could if desired be fitted at the same time.

Figure 5:
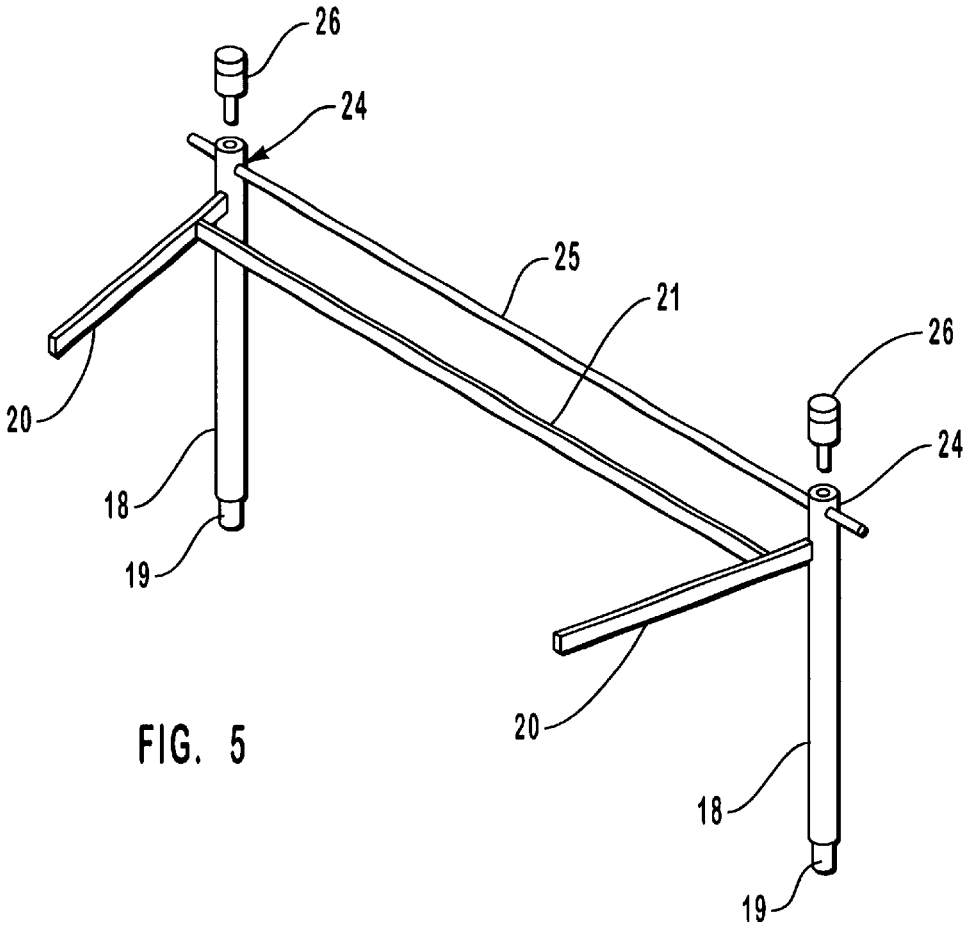
FIG. 5 is a detail of the support posts and shelf supporting frame in the work station support.
Figure 6:
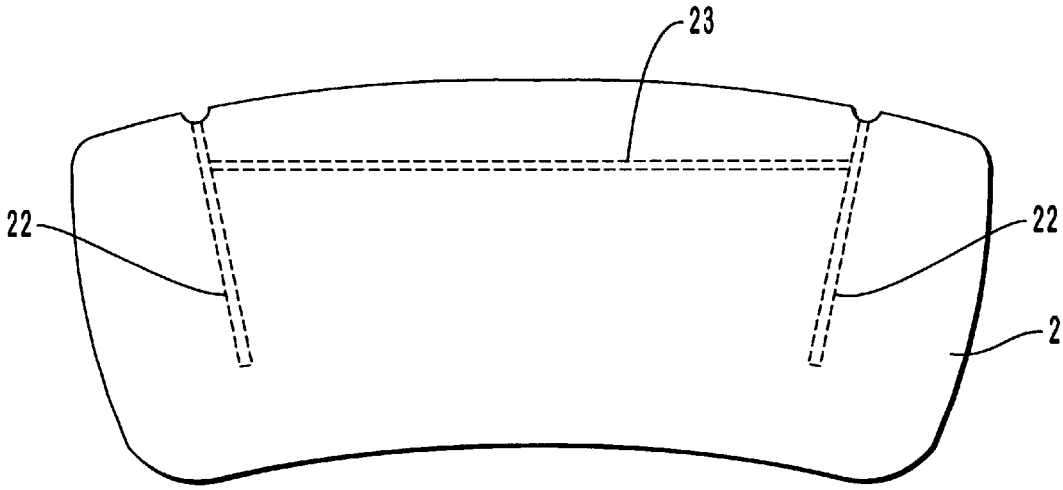
FIG. 6 is a detail of the under surface of a shelf to be supported on the shelf support arms.

The shelf support is illustrated in FIG. 5 and comprises two posts 18 each having a lower end 19 of reduced diameter to engage through the aperture 8. In the illustrated preferred example two arms 20 are provided, one extending from each post 18, and a connecting brace 21 joins the arms. This means that when the posts 18 are engaged in the fitted brackets 4 the brackets are not free to rotate and hence are locked in position.

The shelf 2 on the under surface has complimentary grooves 22 into which will fit the arms 20 and a groove 23 into which the brace 21 will engage. The connection may be affected by any suitable fastening means but preferably it has been found desirable to fix the shelf in place by using an adhesive to retain the arms 20 and brace 21 in place in their respective grooves.

Within the ambit of the invention it would be possible to have a different support frame to hold the shelf but it would be desirable to ensure that in the support frame once the posts are in position there is a locking action to retain the brackets in place if this function was not fulfilled by the screen. The manner in which the shelf is connected to the posts could utilise any of the numerous means of allowing detachable attachment of shelves to the posts.

Figure 8:
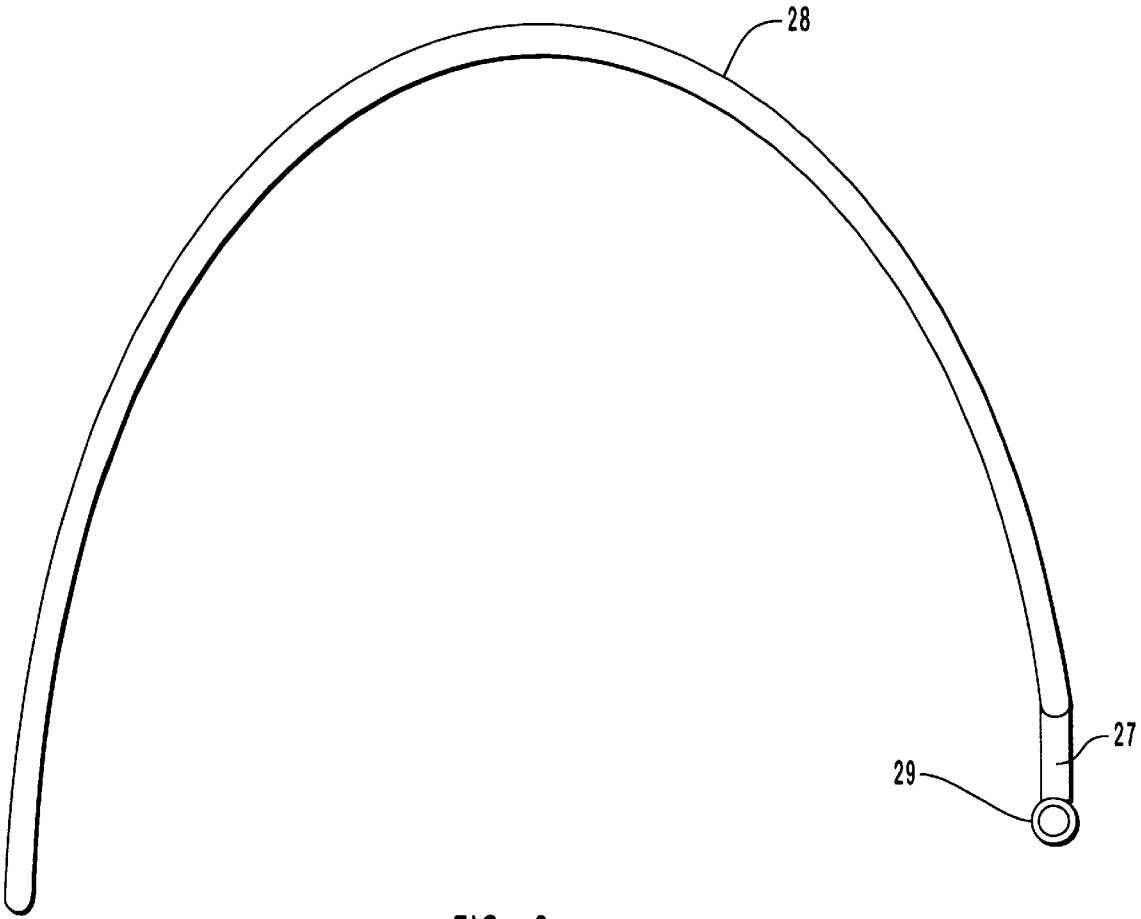
FIG. 8 is a side view of the retaining arm.
Figure 7:
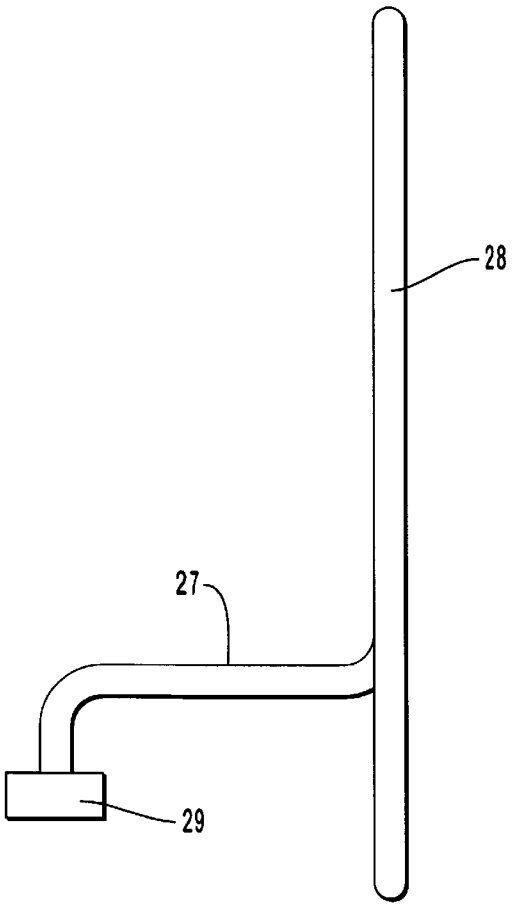
FIG. 7 is an elevation of a retaining arm associated with the shelf on the work station support.

For convenient operation at a work station one of the requirements is to retain in a tidy manner material stored on the shelf. The present invention addresses this requirement by providing a back rail 25 extending through appropriately positioned apertures 24 towards the top of the posts. The top of the posts preferably include a threaded aperture into which the threaded stem of a top 26 may engage and when engaged act to lock or retain the back rail 25 in position. The rail 25 provides a back stop for articles on the shelf but also more importantly ensures a support for retaining arms that can be used to retain articles on the shelf. A retaining arm is illustrated in FIGS. 7 and 8 of the drawings. Two such retaining arms are provided in an opposite handed relationship on the rail 25. The rail 25 and retaining arms could be dispatched separately and could be assembled on site without requiring any tools for such fitting.

The retaining arm comprises a bush 29 having a slidable fit on the rail 25 and an arm 27 shaped to extend up and away from the bush effectively parallel with the rail 25. The arm then continues as an arc or suitably shaped end 28 to act as a holder or stop. Any force against the section 28 of the arm will tilt the bush 29 causing it to engage or lock on the rail 25 thus effecting the retaining action required. By a suitable pressure to relocate the bush the holder can be located so that the bush can freely slide along the rail 25. In this way a convenient retaining means is formed on the back rail 25 to be used in association with the shelf 2.

The present invention desirably encapsulates the advantages for the work station support provided by the mounting bracket and the shelf support but an effective support could be achieved using a fixing plate which is fixed by more conventional fastenings such as by screws into the under surface of the work station while still preserving the remaining features of the present invention as disclosed and it is intended that this should be incorporated within the ambit of the present invention.

As stated above the screen 3 can be fitted separately or it may be included with the shelf support. In many instances it will be desirable for a screen to be fitted by itself.

Where the screen is supplied it is desirable to ensure there is a degree of height adjustability and this can be achieved by providing a plurality of apertures and vertical rows spaced to correspond with the location of tile studs 10 on the facing plate of the fixed mounting brackets 4. The screen can be of any convenient material but preferably a perforated metal screen is both aesthetically pleasing and convenient for fitting in position to retain the mounting brackets in place. Selecting the appropriate apertures to determine the height of the screen allows the screen to be fitted by engaging the screen apertures over the heads of the stud 10 and allowing the screen to drop into the supported position. The screen can assume the peripheral shape of the work station periphery allowing for a flexibility in design that is desirable in the modern working environment.

The present invention thus has a number of advantages in establishing a modern and conveniently adjustable work station support for a shelf or shelves or a screen associated with a work station top in an office or office type environment.

What is claimed is:

1. A mounting bracket for a workstation having a pair of spaced apart mounting studs attached thereto, the mounting bracket comprising:

an elongated arm having a first end and an opposing second end;

a holder provided at or adjacent to the first end of the arm; and a fixing plate provided at or adjacent to the second end of the arm, the fixing plate having a center of rotation and two separate keyhole slots arranged on a locus about the center of rotation, each keyhole slot having a wider part and a narrower part, each of which extends along the locus about the center of rotation, each wider part of each keyhole slot being adapted to receive a respective mounting stud on the workstation such that rotation of the mounting bracket about the center of rotation causes the mounting studs to be received in the narrower parts of the respective keyhole slots, thereby engaging the fixing plate to the workstation.

2. The mounting bracket as claimed in claim 1 wherein the fixing plate is disposed in a plane, the arm longitudinally extending from the fixing plate in a direction substantially parallel to the plane of the fixing plate.

3. The mounting bracket as claimed in claim 1 wherein each keyhole slot has two narrower parts extending along the locus, the wider part being centrally disposed between the two narrower parts.

4. The mounting bracket as claimed in claim 1 wherein the two keyhole slots are diametrically opposed.

5. The mounting bracket as claimed in claim 4 wherein the holder comprises a head connected to the arm, the head having an aperture formed therein.

6. The mounting bracket as claimed in claim 5 wherein the aperture extends orthogonally to the longitudinal direction of the arm.

7. The mounting bracket as claimed in claim 1 further comprising:

a face plate mounted at the first end of the arm; and a pair of headed studs projecting from the face plate.

8. The mounting bracket as claimed in claim 1 wherein the fixing plate is circular and the center of rotation corresponds to the center of the fixing plate.

9. A workstation assembly comprising:

a workstation;

a first mounting bracket, the first mounting bracketing comprising:

an elongated arm having a first end and a second end; and a holder provided at or adjacent to the first end of the arm;

a first engagement portion comprising a pair of spaced apart mounting studs, each mounting stud having an enlarged head; and a second engagement portion comprising a fixing plate having a center of rotation and two separate keyhole slots arranged on a locus about the center of rotation, each keyhole slot having a wider part and a narrower part, each of which extends along the locus about the center of rotation, each wider part of each keyhole slot being adapted to receive the head of a respective mounting stud of the first engagement portion such that the respective mounting stud can subsequently be advanced into the narrower part of the respective keyhole slot, a select one of the first engagement portion and the second engagement portion being mounted on the workstation, the other of the first engagement portion and the second engagement portion being provided at or adjacent to the second end of the arm, thereby enabling attachment of the first mounting bracket to the workstation.

10. The workstation assembly as claimed in claim 9 wherein the mounting studs are provided on the workstation and the fixing plate is mounted on the arm.

11. The workstation assembly as claimed in claim 10 wherein the workstation comprises a workstation top, the workstation top having a bottom side and a top side, the mounting studs being disposed on the bottom side of the workstation top.

12. The workstation assembly as claimed in claim 11 wherein the fixing plate comprises a circular plate and a recess is provided on the bottom side of the workstation top to receive the circular plate.

13. The workstation assembly as claimed in claim 9 wherein the fixing plate is disposed in a plane, the arm longitudinally extending from the fixing plate in a direction substantially parallel to the plane of the fixing plate.

14. The workstation assembly as claimed in claim 13 wherein the workstation comprises a workstation top having a back edge, the holder being disposed in a vertical plane beyond the back edge of the workstation top when the workstation top is in a horizontal plane.

15. The workstation assembly as claimed in claim 13 wherein the holder comprises a head connected to the arm, the head having an aperture formed therein.

16. The workstation assembly as claimed in claim 15 wherein the aperture extends orthogonally to the longitudinal direction of the arm.

17. The workstation assembly as claimed in claim 9 wherein each keyhole slot has two narrower parts extending along the locus, the wider part being centrally disposed between the two narrower parts.

18. The workstation assembly as claimed in claim 9 wherein the two keyhole slots are diametrically opposed.

19. The workstation assembly as claimed in claim 9 further comprising a second mounting bracket, the second mounting bracket comprising:

an arm having a first end and a second end, the second end being selectively attached to the workstation top; and a holder provided at or adjacent to the first end of the arm.

20. The workstation assembly as claimed in claim 19 further comprising:

a face plate mounted at the first end of the arm of the first mounting bracket; and a pair of headed studs projecting from the face plate.

21. The workstation assembly as claimed in claim 20 further comprising a screen mounted on the headed studs.

22. The workstation assembly as claimed in claim 19 further comprising:

a shelf frame including two posts, each post being held by and extending upward from a respective holder of the first mounting bracket and the second mounting bracket; and a shelf supported by the shelf frame.

23. The workstation assembly as claimed in claim 22 further comprising:

a rail extending between the two posts; and a retainer comprising a bush slidably mounted on the rail and a retaining arm projecting from the bush so as to extend over at least a portion of the shelf.

24. The workstation assembly as claimed in claim 23 wherein the retaining arm comprises an arc portion lying in a plane substantially orthogonal to the plane of the shelf and extending transversely across the shelf.

25. The workstation assembly as claimed in claim 23 wherein the rail is disposed higher than the shelf so that the rail acts as a backstop for the shelf.

26. A workstation assembly comprising:

a workstation top having an attachment surface;

a first pair of spaced apart mounting studs and a second pair of spaced apart mounting studs each projecting from the attachment surface, each mounting stud terminating at an enlarged head;

a first mounting bracket comprising:

a first arm having a first end and a second end;

a first holder provided at or adjacent to the first end of the first arm;

a first fixing plate secured at or adjacent to the second end of the first arm, the first fixing plate having a first pair of spaced apart keyhole slots formed therein, each keyhole slot having a wider part and a narrower part, the first pair of keyhole slots being configured to receive the first pair of mounting studs such that as the first fixing plate is rotated in a first direction, the first pair of mounting studs are received within the narrower parts of the first pair of keyhole slots; and a second mounting bracket comprising:

a second arm having a first end and a second end;

a second holder provided at or adjacent to the first end of the second arm; and a second fixing plate secured at or adjacent to the second end of the second arm, the second fixing plate having a second pair of spaced apart keyhole slots formed therein, each of the second keyhole slots having a wider part and a narrower part, the second pair of keyhole slots being configured to receive the second pair of mounting studs such that as the second fixing plate is rotated in a second direction opposite the first direction of the first fixing plate, the second pair of mounting studs are received within the narrower parts of the second pair of keyhole slots.

27. The workstation assembly as claimed in claim 26, wherein the workstation top has a top side and a bottom side each extending between a front edge and a back edge, the attachment surface comprising the bottom side of the workstation top.

28. The workstation assembly as claimed in claim 27, wherein the first pair of mounting studs are disposed within a recess formed on the bottom side of the workstation top, the recess being configured to receive the first fixing plate.

29. The workstation assembly as claimed in claim 27, wherein the first holder and the second holder are disposed beyond the back edge of the workstation top when the first pair of mounting bolts are received within the narrow parts of the first pair of keyhole slots and the second pair of mounting bolts are received within the narrow parts of the second pair of keyhole slots.

* * * * *

UNITED STATES PATENT AND TRADEMARK OFFICE

CERTIFICATE OF CORRECTION

PATENT NO. : 6,289,826 B1
DATED : September 18, 2001
INVENTOR(S) : Neville Waisbrod It is certified that error appears in the above-identified patent and that said Letters Patent is hereby corrected as shown below:

Column 1,
Line 22, after "Within the" change "modem" to -- modern --

Column 5,
Line 9, after "claim" change "4" to -- 2 --

Signed and Sealed this

Eighth Day of April, 2003

JAMES E. ROGAN
*Director of the United States Patent and Trademark Office*